US006315027B1

(12) United States Patent
Lichy

(10) Patent No.: US 6,315,027 B1
(45) Date of Patent: Nov. 13, 2001

(54) OVERHEAD SECTIONAL DOOR AND DOOR HINGE

(75) Inventor: Dale M. Lichy, Gibsonia, PA (US)

(73) Assignee: ThruWays Doorsystems, Inc., Pittsburgh, PA (US)

( * ) Notice: Subject to any disclaimer, the term of this patent is extended or adjusted under 35 U.S.C. 154(b) by 0 days.

(21) Appl. No.: 09/522,992

(22) Filed: Mar. 9, 2000

Related U.S. Application Data

(60) Provisional application No. 60/123,747, filed on Mar. 9, 1999.

(51) Int. Cl.[7] ..... E05D 15/16; E05D 7/12

(52) U.S. Cl. ..... 160/205; 160/229.1; 16/271

(58) Field of Search ..... 160/205, 201, 160/200, 229.1; 16/271

(56) References Cited

U.S. PATENT DOCUMENTS 1,172,512 * 2/1916 Angelovich .
1,469,525 * 10/1923 Nadolney .
4,016,920 * 4/1977 Shepard .
4,676,293 6/1987 Hanssen .
5,535,805 7/1996 Kellogg et al. .
5,584,333 12/1996 Torchetti et al. .
5,720,332 * 2/1998 Nachreiner .
5,727,614 3/1998 Lichy .
5,887,385 * 3/1999 Horner et al. .
5,937,480 * 8/1999 Kiefer .
6,148,897 * 11/2000 Horner et al. .

FOREIGN PATENT DOCUMENTS

WO 99/22103 5/1999 (WO) .

* cited by examiner

*Primary Examiner*—Blair M. Johnson
(74) *Attorney, Agent, or Firm*—Jacobson Holman, PLLC

(57) ABSTRACT

A hinge mechanism particularly suitable for hinging releasable rectangular panels of overhead sectional doors. The hinge mechanism includes first and second hinge plates hinged to each other wherein one of the hinge plates is slidably mounted within a base plate affixed to a rectangular panel to enable the entire hinge mechanism to move longitudinally with respect to the base plate, and thus enable the rectangular panels to move longitudinally with respect to each other, to enable pivoting or rotation of the releasable panel in a direction opposite to the face where the hinge and face plate are mounted.

35 Claims, 22 Drawing Sheets

OVERHEAD SECTIONAL DOOR AND DOOR HINGE

This application claims the benefit of U.S. Provisional Application No. 60/123,747, filed on Mar. 9, 1999.

BACKGROUND OF THE INVENTION

1. Field of the Invention

The invention relates to (1) a hinge mechanism for interconnecting rectangular panels such as door panels and (2) an overhead sectional breakaway door formed of a plurality of rectangular panels connected to each other and disposed adjacent a door opening and including the hinge mechanism on at least the breakaway door panels, whereby the rectangular door panels are movable vertically to open and close the door opening. Channels or tracks are vertically mounted adjacent side edges of the door opening. The rectangular panels may include guide elements such as rollers that are guided within the tracks to enable the door to move vertically. At least the bottommost rectangular panel is a releasable, breakaway panel. The releasable panels are substantially rigid, i.e. free of substantial flexure at least at peripheral regions, and at least the bottommost panel includes a releasable retainer mechanism connected to the panel to retain the panel in position with respect to the tracks during normal or routine movements of the door and for releasing the panel to enable freely swinging movement of the releasable panel with respect to the tracks or channels when a predetermined impact force is applied to the releasable panel. The novel hinge mechanism provides a unique pivotal connection between adjacent panels to enable the panels to pivot in opposite directions, i.e. inwardly and outwardly (or clockwise/counter-clockwise when locking from an end viewpoint) whereby when the panel is impacted to break free of the track in a specific direction, vertical movement or separation of the panels with respect to each other will be accompanied by a simultaneous pivotal movement.

2. Description of Related Art

Overhead doors formed from a plurality of rectangular panels that are hingedly connected to each other, and including rollers which are guided within guide channels or tracks positioned adjacent the side edges of the door opening, arc known in the art. Such overhead doors move vertically with the rollers captured within the channels or tracks. The channels or tracks may curve from a vertical into a horizontal position in a relatively short distance above the door opening, an arrangement known as a standard lift overhead door system. In another arrangement, called a high lift system, the track also curves but over a greater distance above the door opening and ultimately into a horizontal position. In another overhead door arrangement, known as a full vertical lift system, the door panels move straight upwards, or at a gentle angle away from the door.

One of the problems with the known overhead door arrangements is that often the rectangular panels are not moved completely out of the door opening perimeter and the lower or bottommost panel extends just below the horizontal door frame which makes it susceptible to being struck by vehicles or objects, such as forklifts, automobiles, trucks, etc. For example, as the door is opening, vehicular traffic, such as fork lifts, etc., try to go through the door opening prior to the door being completely out of the opening. Similarly, when the door is just beginning to close, and vehicular traffic is unaware of the closing, the door may be struck by the vehicle. Still another problem could arise when the door is closed and is accidentally bumped in the closed position resulting in damage to the door making it inoperative. Thus a need has arisen to design an overhead door system that minimizes the damage to at least the bottommost rectangular panels when struck by motor vehicles or other tall structures that pass through the door opening.

One such breakaway door having a releasable rectangular panel is described in applicant's U.S. Pat. No. 5,727,614, issued on Mar. 17, 1998 and entitled Overhead Door With Releasable Breakaway Panel. The embodiment of FIGS. 1–6 of the above U.S. Pat. No. 5,727,614 (without the spring biasing arrangement 91) may be deemed prior art. Reference should also be made to U.S. Pat. Nos. 4,676,293 (Hanssen), 5,535,805 (Kellogg et al.), and 5,584,333 (Torchetti et al.).

Because standard overhead doors such as garage doors can sustain a great deal of damage, if not completely destroyed, when impacted, the products developed over the past several years address the damage problem in various ways. Many doors have been developed to sustain an impact due to the materials used to make the panel itself. All of the new panels designed to withstand an impact have had to address at least two significant issues. First, the panel had to release from the opening at some predetermined force because no material could be both economically priced and withstand a vehicular force unless it released from the tracking system. Secondly, the panel had to swivel inwardly and outwardly in order to take an impact from both directions.

Two somewhat rectangular shaped panels, such as garage door panels, when pivotally connected to each other cannot pivot in both directions using standard garage door hinges. A standard garage door hinge is very efficient for use on standard garage door applications. The standard hinge is designed to allow the panel to pivot in one direction thereby allowing each independent panel to follow a curve in the track when raising out of the opening. These standard garage doors are not however, manufactured to withstand an accidental impact, from either direction, to the section without anticipated damage discussed above. Double-pinned hinges have been designed for other types (i.e., horizontal swinging about a vertical axis) of door products, such as free-swinging kitchen doors, to allow for two-way pivoting action about a vertical axis, but there is no known automatically adjustable single pin hinge designed for a sectional door that pivots about a horizontal axis.

SUMMARY OF THE INVENTION

The present invention relates to a single pin hinge mechanism that joins two rectangular panels, such as garage door or overhead sectional door panels, and enables the panels to swivel or pivot in one direction about the hinge pin and to enable the panels to swivel in the opposite direction by automatically adjusting the vertical position of the hinge pin. The hinge mechanism is positioned either on the inside or outside of the rectangular panel faces and includes a single pin hinge that allows pivoting about the pin when the panel is released in a first direction and allows the breakaway panel to move with a downward component and to simultaneously pivot in the opposite direction if impacted in the opposite direction. Thus, the hinge mechanism of the present invention allows a releasable or breakaway door panel to swivel or pivot outwardly if the hinge mechanism is mounted on the inside, by automatically adjusting the vertical position of the pivot pin and the panels to allow for the thickness of the panels.

For a breakaway door panel that is manufactured to withstand an impact with little, if any, damage to the panel or associated hardware, the single pin adjustable hinge mechanism of the present invention has several advantages when applied to vertically moving sectional doors. If the panel is impacted inwardly, with the hinge mechanism mounted on the interior faces of the panels, the hinge does not have to adjust downward because it is not pivoting through or, rather around, the thickness of the panel. If however, the panel is impacted outwardly, the pressure of the panel trying to pivot outward toward the thickness of the two panels causes a hinge keeper to release a hinge plate from a base plate affixed to the panel face. Due to internal guides along the base plate, the hinge plate is safely retained from permanent dislocation from the panel. Upon release by the hinge keeper, the hinge plate drops to a position that allows for the panel to swivel around the thickness of the panel thereby causing little, if any, damage to the panel or related hardware.

It is an object of the present invention to provide for an adjustable hinge mechanism for interconnecting two rectangular panels so that they are rotatable or pivotable in both directions when at least the bottommost panel is impacted. The hinge mechanism includes a hinge having a first hinge plate and a second hinge plate where the first hinge plate is affixed to a face of a first rectangular panel and where the second hinge plate is captured and retained within a base plate that is affixed to the adjacent panel. When the panels are rotated relative to each other such that the panel faces that have the hinge mechanism affixed thereto converge, the rotation takes place about the single hinge pin in a relatively conventional manner. However, when the panels are moved or rotated in the opposite direction, i.e. rotated in a direction where the panel faces opposite to where the hinge mechanism is attached, converge, there is relative separation or longitudinal movement between the two panels to enable the panels to rotate.

It is further an object of the present invention to provide an overhead sectional door employing the novel hinge of the present invention to enable one or more door panels to release or breakaway from the vertical tracks adjacent the door opening and to enable swinging or pivotal movement in directions into and outside of the door opening depending upon the direction the panel is hit.

DETAILED DESCRIPTION OF PREFERRED EMBODIMENTS

Figure 3:
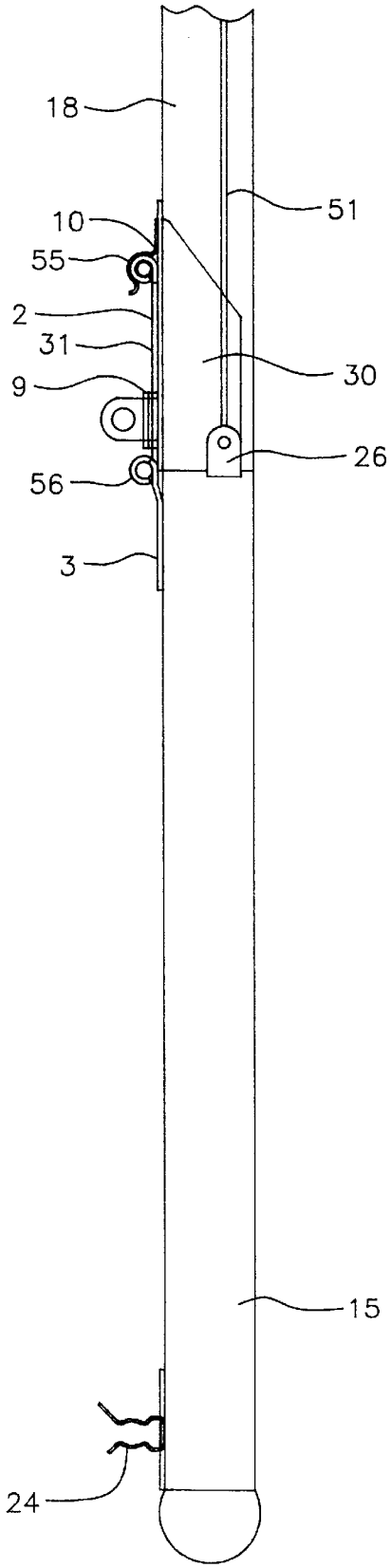
FIG. 3 is an end or side view of the door panels of FIG. 2.
Figure 21:
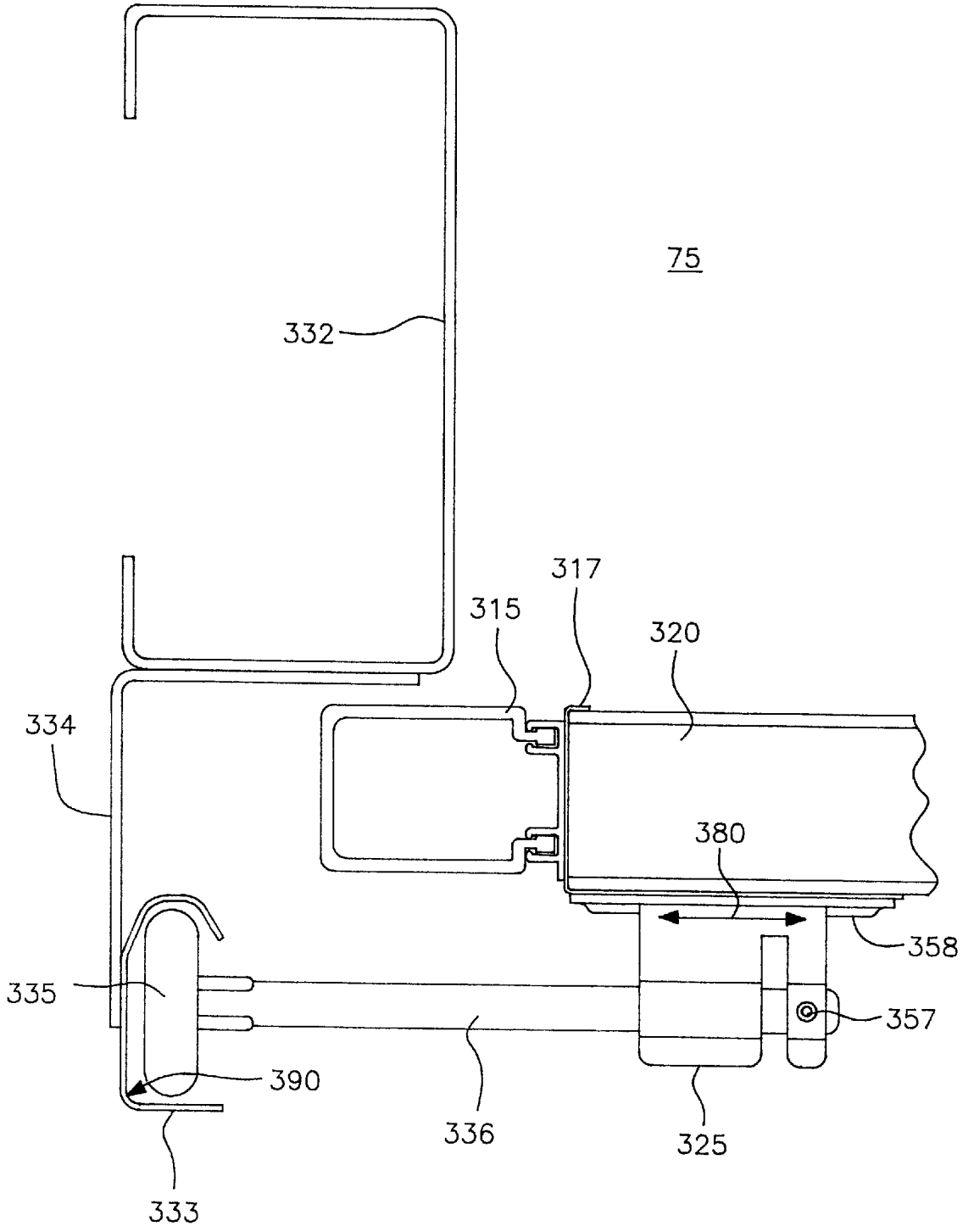
FIG. 21 is a view looking down at a breakaway door panel to show a flexible track and an alternative embodiment of the releasable roller retainer mechanism.
Figure 22:
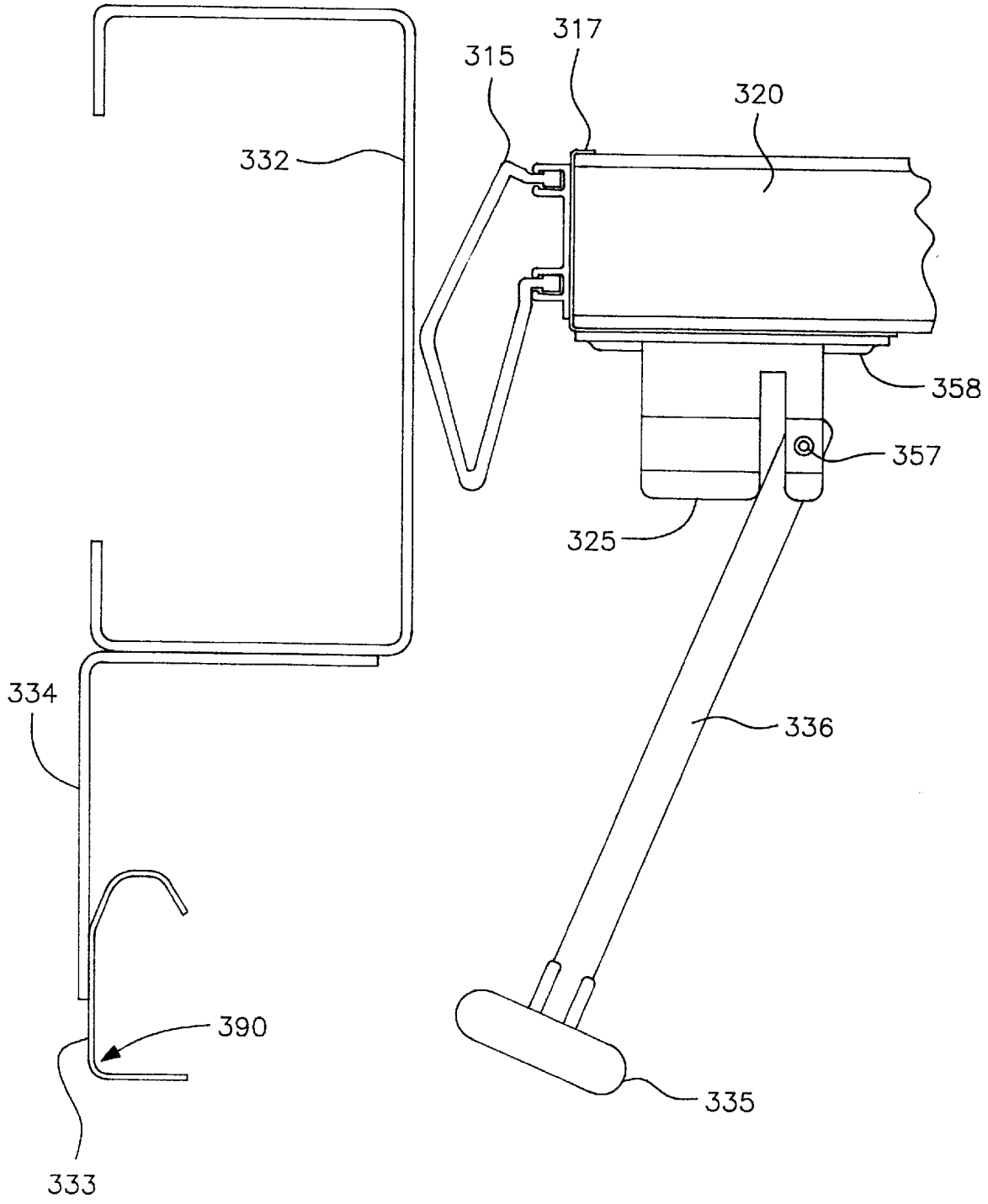
FIG. 22 shows the release of the roller mechanism of FIG. 21.

The sectional door embodiments described below all have rectangular panels such as non-releasable panels 19, 119 and releasable panels 20, 120 going across a door opening 75 from side to side. The panels are raised and lowered to open and close the opening for traffic to pass through, as required. The weight of the panels is counter balanced by springs 50 or counter weights (not shown) which are in turn indirectly fastened to a cable 51 which is directly fastened to either the upper panel (see FIG. 16) or a bottom hinge mechanism 1 on a lower panel at 26 as shown in FIG. 3. Each of the doors have at least one of the panels with hardware made to allow the releasable panel to disengage from the tracks 33 133, 233, 333 upon impact. All of the breakaway panels use similar roller retainer mechanisms 24 which allow the roller 35 and roller shaft 36 to disengage from the track 33. See FIG. 15. An alternative roller retainer mechanism is depicted in FIGS. 21 and 22.

The sectional door embodiments described herein are similar to those described in applicant's U.S. Pat. No. 5,727,614 (the "Lichy '614 patent") and in applicant's International Application WO 99/22103 published May 6, 1999, based on U.S. application Ser. No. 08/958,393 filed Oct. 27, 1997 (now abandoned) (the "Lichy International Application"). The Lichy '614 patent and Lichy International Application are incorporated by reference to the extent necessary to describe details in common with the present invention. For example, the releasable roller retainer mechanisms and associated spring clips (as now depicted in FIG. 15) are described and incorporated by reference herein.

Turning first to the embodiment depicted in FIGS. 1–9 and 15, a single releasable panel 20 is hingedly coupled through the novel hinge mechanism 1 of the present invention to a non-releasable panel 19. The hinge mechanism 1 is at each upper corner of the panel 20 and corresponding bottom corner of the adjacent panel 19. The releasable panel 20 includes end elements 15 that are flexible to move through the doorjamb 32. See FIG. 15. The non-releasable panels 19 include a rigid end cap 18 upon which hardware is mounted including the base plate 30 of hinge mechanism 1 on each side of the panel. Fixed to the fixture or base plate 30 is a roller mechanism 35 that rolls within a vertical track 33, on each side of the door opening, as is known in the art. See for example, the Lichy '614 patent. As is generally known, the side-to-side width of the non-releasable panels may be greater than the side-to-side width of the door opening. See, FIGS. 15, 21, 22. The vertical channels or tracks 33 are mounted on walls adjacent the door opening or independently supported adjacent the door opening. The configuration or curvature of the channels 33 may differ depending upon the specific type of door arrangement.

The breakaway panel 20 is substantially rigid at least on its perimeter and substantially free of flexure other than, of course, the flexible side edges 15.

Figure 1:
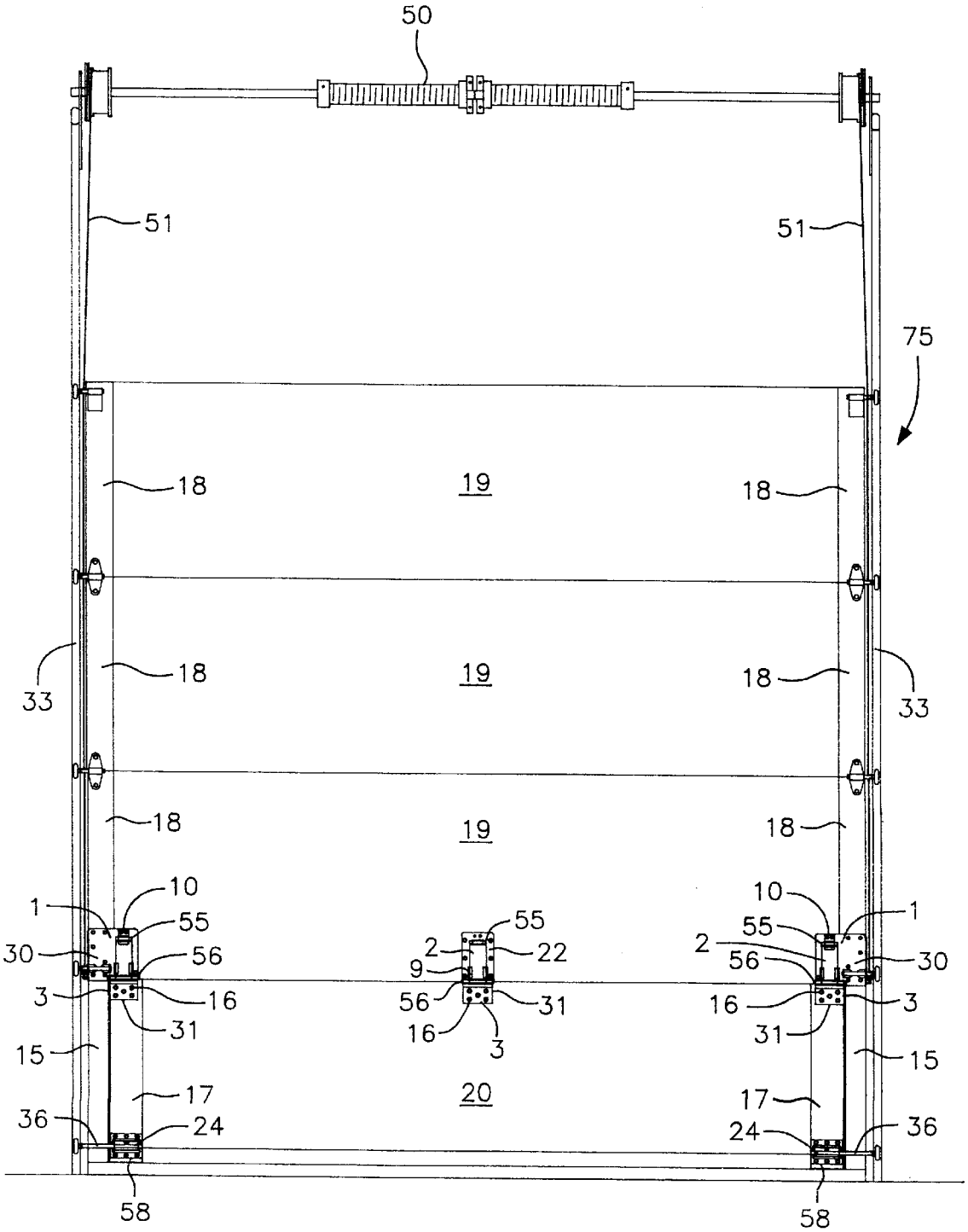
FIG. 1 is an elevation or front view of a sectional door from inside a building with one breakaway bottom panel.
Figure 2:
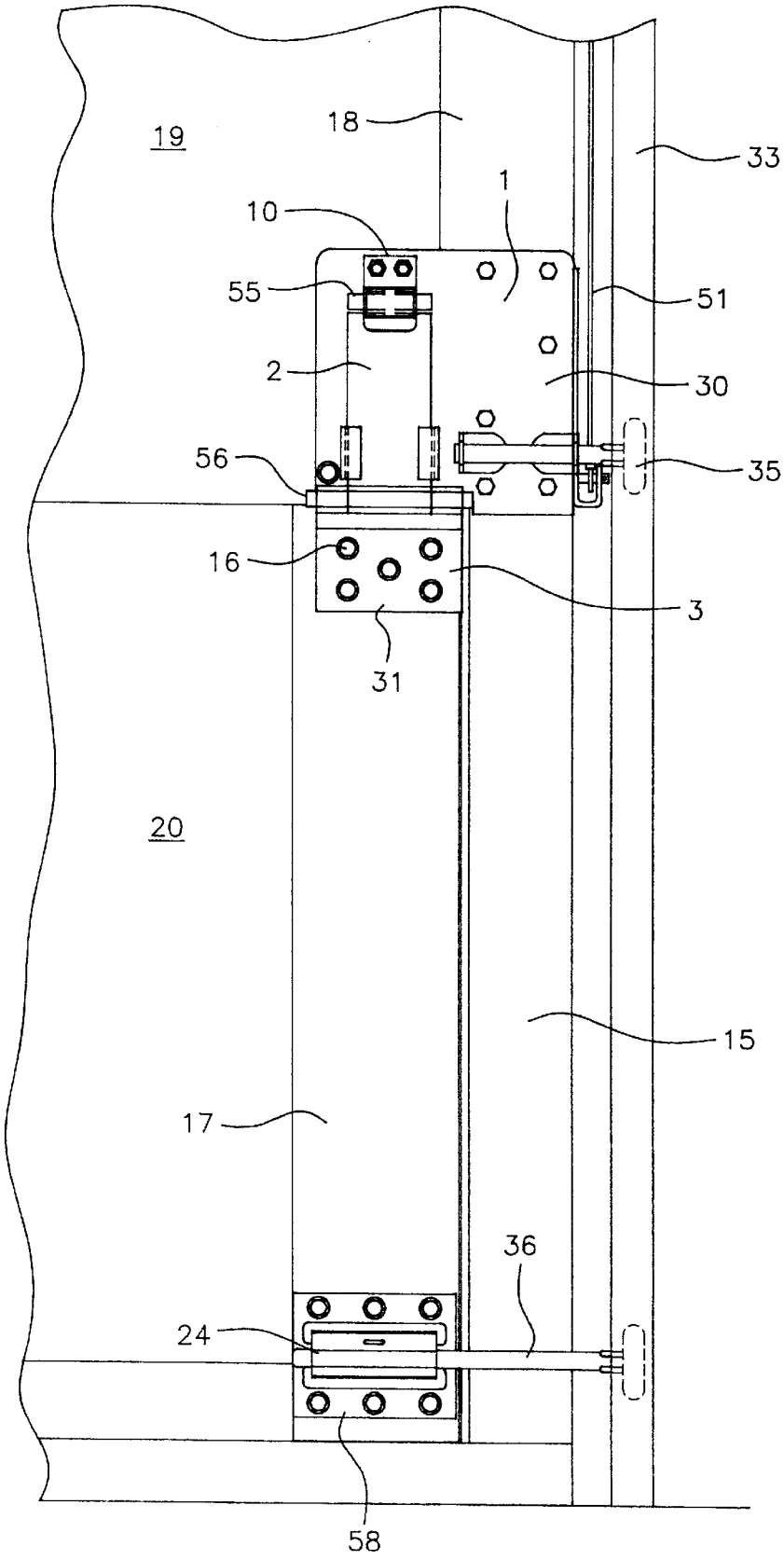
FIG. 2 shows the right hand corner of the bottom and adjacent panels of FIG. 1, and the hardware attached thereto.
Figure 4:
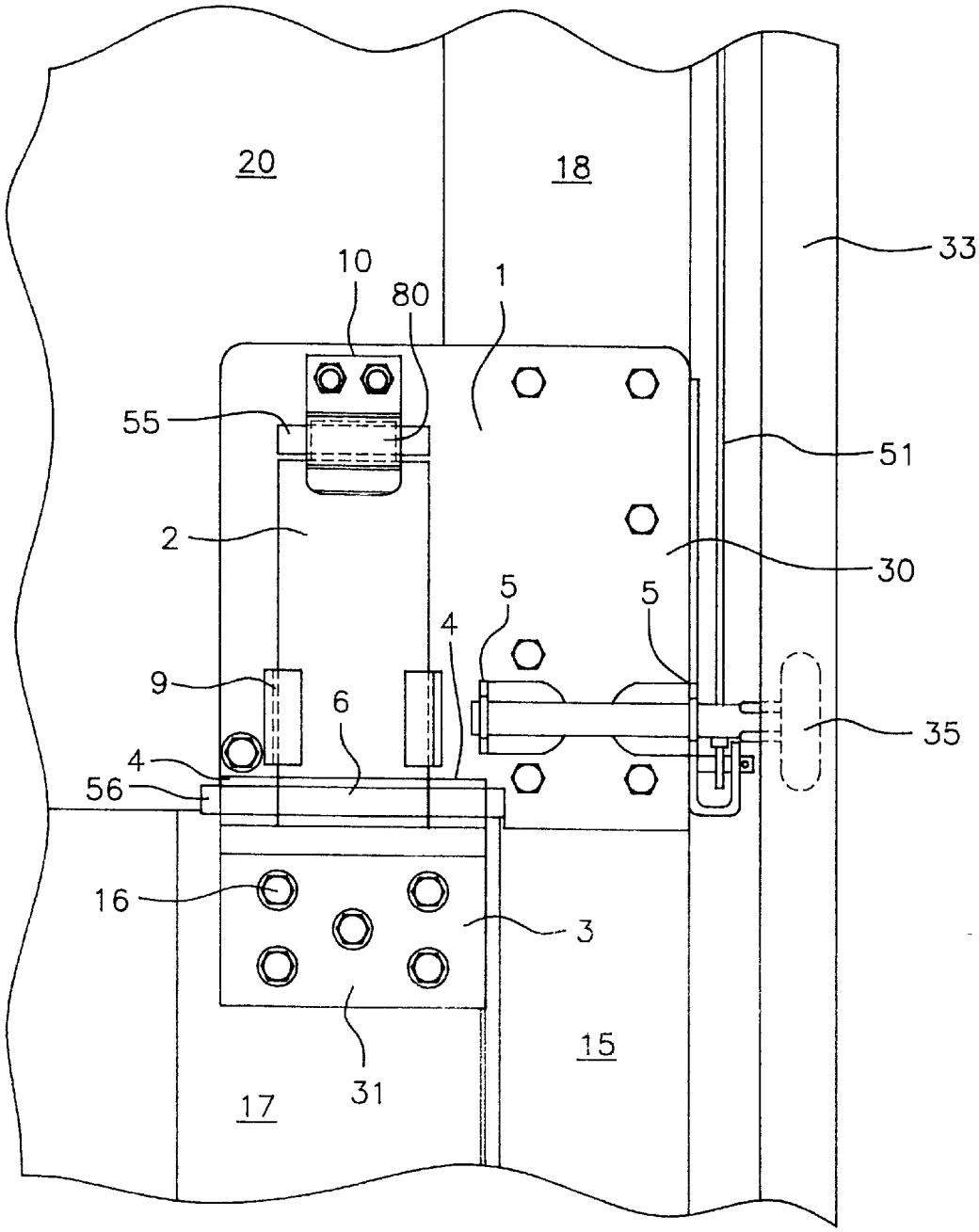
FIG. 4 is a close-up view of the hinge mechanism or assembly of FIGS. 1–3.
Figure 5:
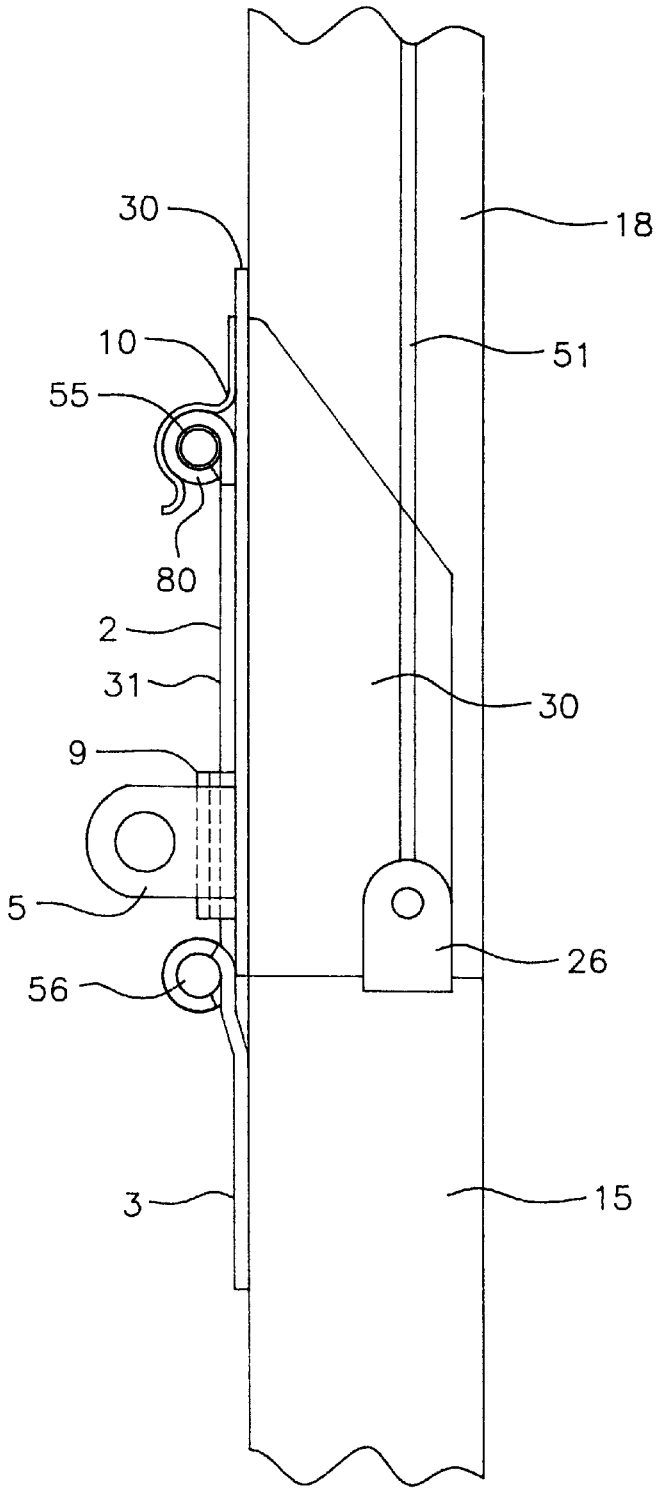
FIG. 5 is a side view of the hinge mechanism of FIG. 4.

As shown in FIG. 1, the hinge mechanism of the present invention includes a first hinge leaf or hinge plate 3 securely fastened to the lower panel 20 end plate or end cap 17 with self-tapping or other appropriate screws 16. The hinge plate 3 includes substantially cylindrical hinge pin receptacles 4, as depicted in FIG. 4, typical of conventional hinges, extending on either side of the plate to receive a hinge pin 56. The hinge plate 3 is hinged to a second hinge plate or leaf 2 which includes a central cylindrical hinge portion 6, also shown in FIG. 4. This second hinge plate 2 extends upwardly and includes a narrowed cylindrical portion 80 to receive, relatively securely, a rod 55. The upper rod 55 and portion 80 is received in a hinge plate keeper or spring clip 10 which is permanently fastened to the base plate 30. The base plate 30 is permanently secured to the adjacent non-releasable rectangular panel 19 through attachment to the end cap 18. The base plate 30 continues and wraps around the side edge of the panel at 30 as shown in FIG. 5.

The spring clip 10 securely retains the hinge plate 2 in normal door operation. When a predetermined impact force in an outward direction is provided to the bottommost releasable panel 20, the hinge plate 2 disengages as will be discussed hereinbelow.

Disposed on either side of the second hinge plate 2 and formed (preferably by stamping out) from the base plate 30 are a pair of substantially L-shaped members 9 that slidably receive the hinge plate 2. Thus, when the hinge plate 2 is released from the spring force of the spring clip 10, it falls by its weight downwardly but is slidably retained to the base plate 30 by the L-shaped retainers 9. This downward movement of the hinge plate 2 with respect to the base plate 1 continues until the rod 55 engages the top of the L-shaped retainers 9. See, FIG. 9. It should be apparent that the pivotal coupling between the bottommost releasable panel 20 and the adjacent non-releasable panel 19 is through the hinge connection between the bottom hinge plate 3 and the upper hinge plate 2 through cylindrical connections 4 and 6 about the hinge pin 56.

Figure 6:
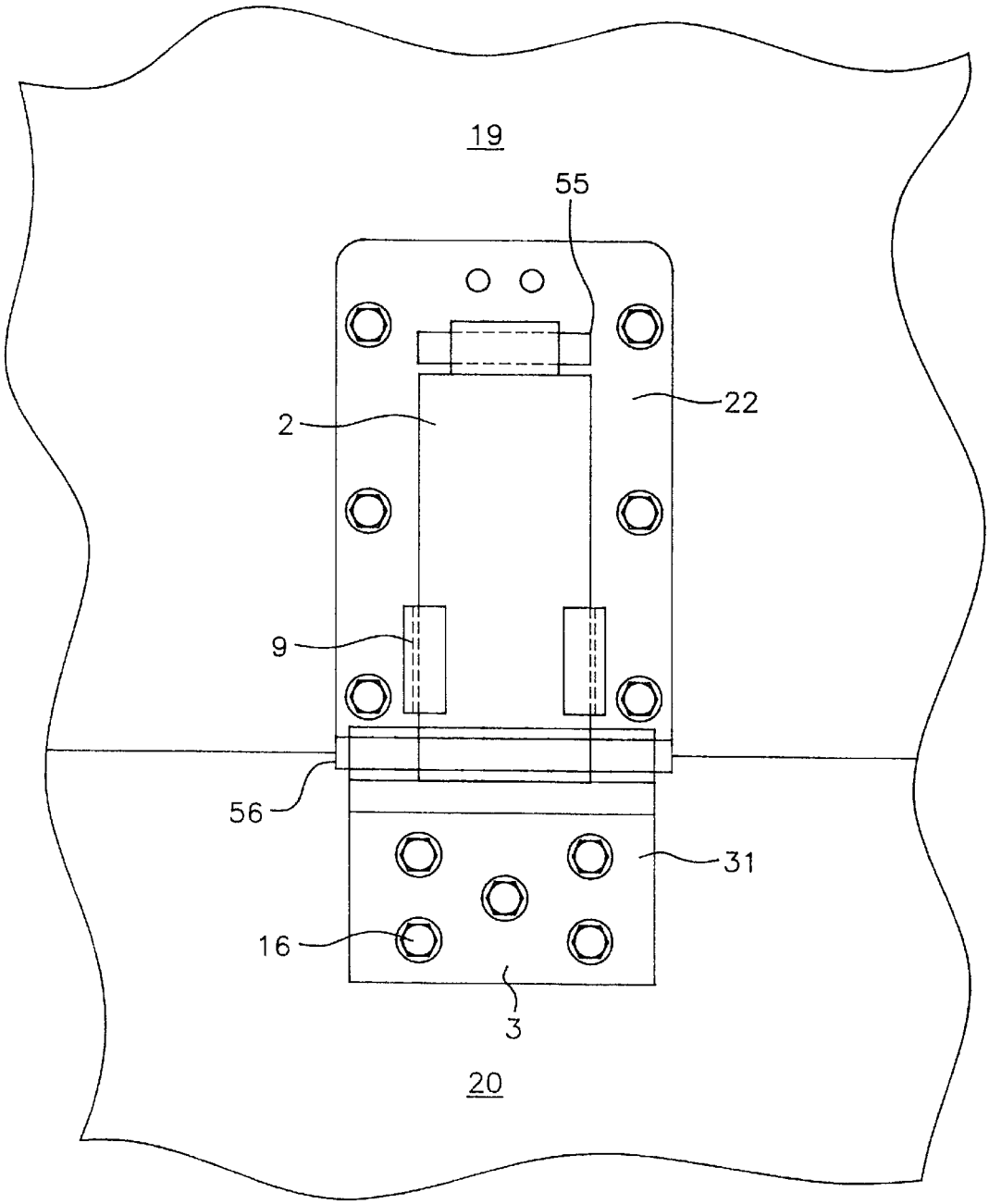
FIG. 6 is a blown-up view of the center hinge shown in FIG. 1.
Figure 7:
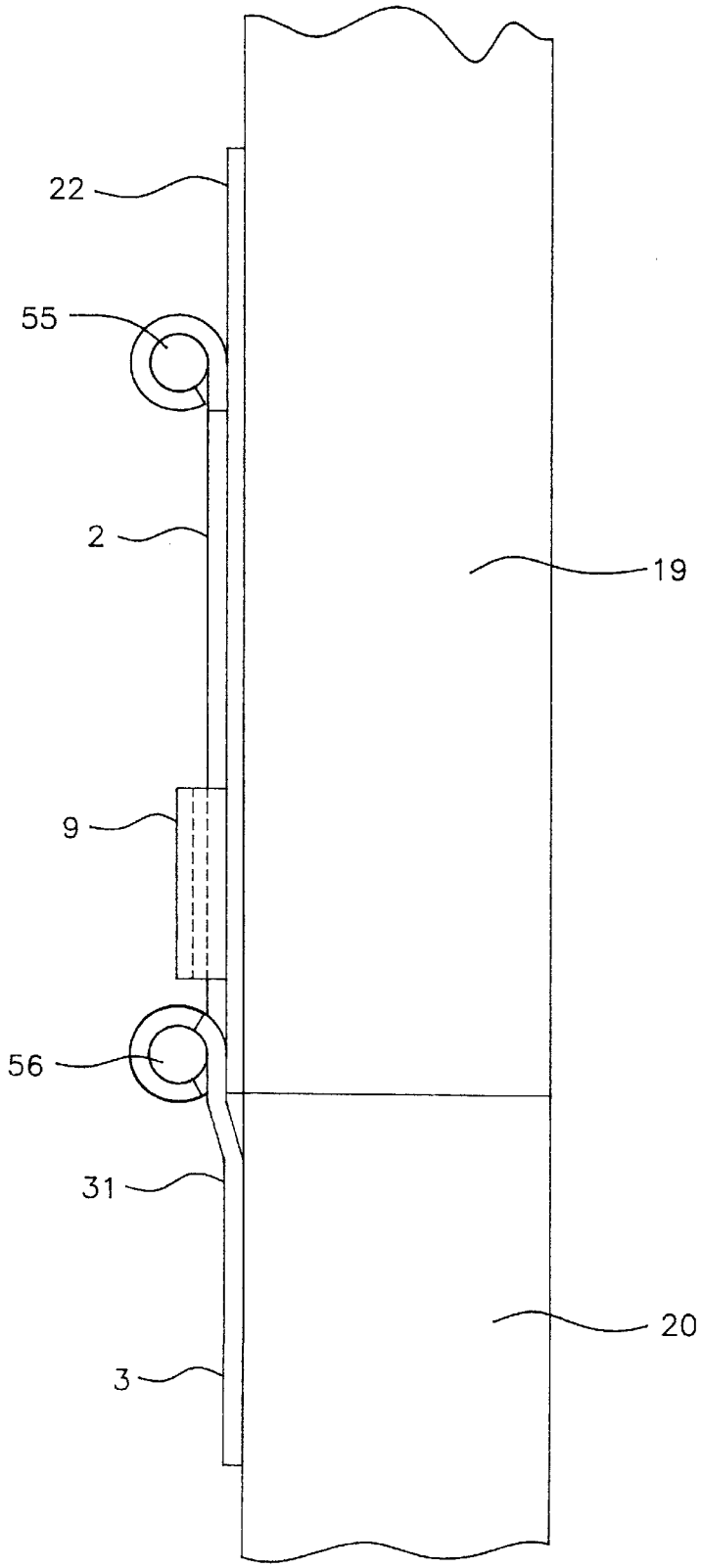
FIG. 7 is an end or side view of FIG. 6.

If the panel is sufficiently wide from side to side, a center hinge mechanism may be utilized as is shown in FIGS. 6 and 7. As is shown, the hinge mechanism in the center is substantially identical to those at either end with, of course, the absence of a roller mechanism that engages with the tracks, and the omission of the spring clip 10. The inclusion of the spring clip 10 is not necessary since the center hinge only provides the guides 9 for enabling the bottommost rectangular panel 20 to move in a longitudinal and simultaneous rotatable or pivotable direction. That is, the upper leaf or hinge plate 2 is slidably captured in the retaining L-shaped tabs 9 to ensure that the bottom panel 20 is aligned with the upper panel 19 without a secure fastening therebetween. It should be emphasized that in most instances a center hinge mechanism is unnecessary.

Figure 8:
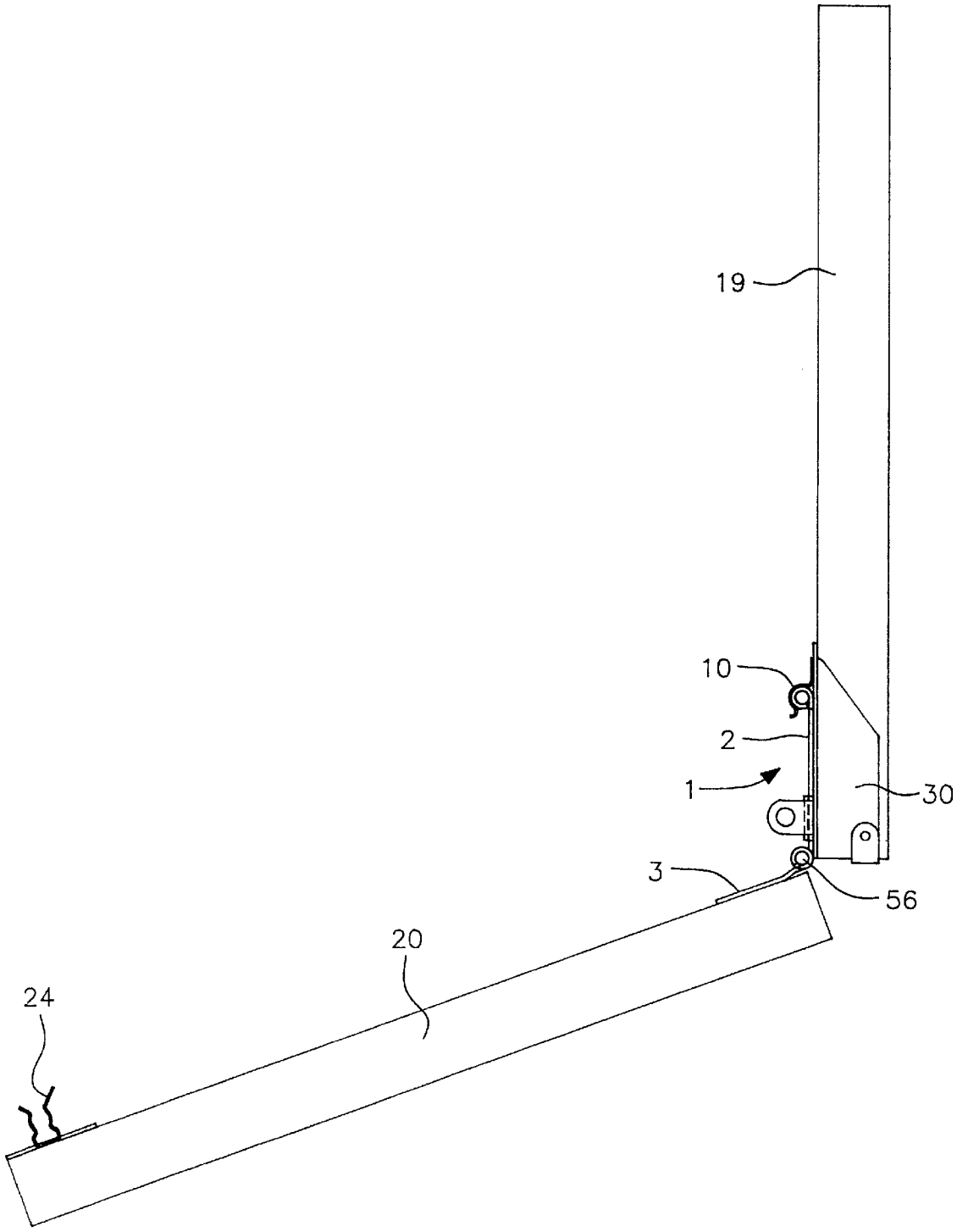
FIG. 8 is a side or end view of the bottom and first adjacent panel showing the panel after it has been impacted inwardly and has released from the vertical track.
Figure 9:
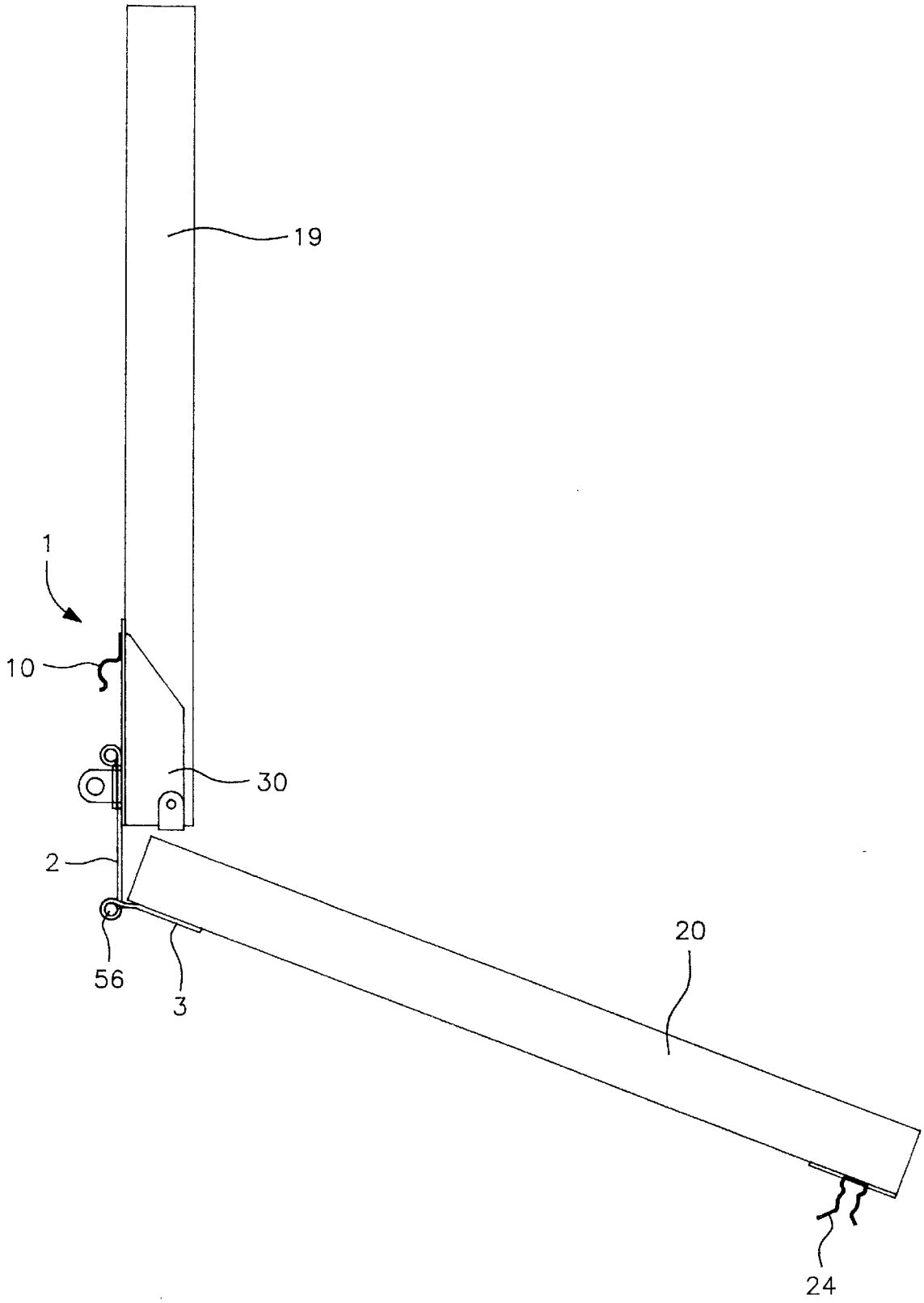
FIG. 9 is a side or end view of the bottom and first adjacent panel showing the panel after it has been impacted outwardly and has released from the vertical track.
Figure 10:
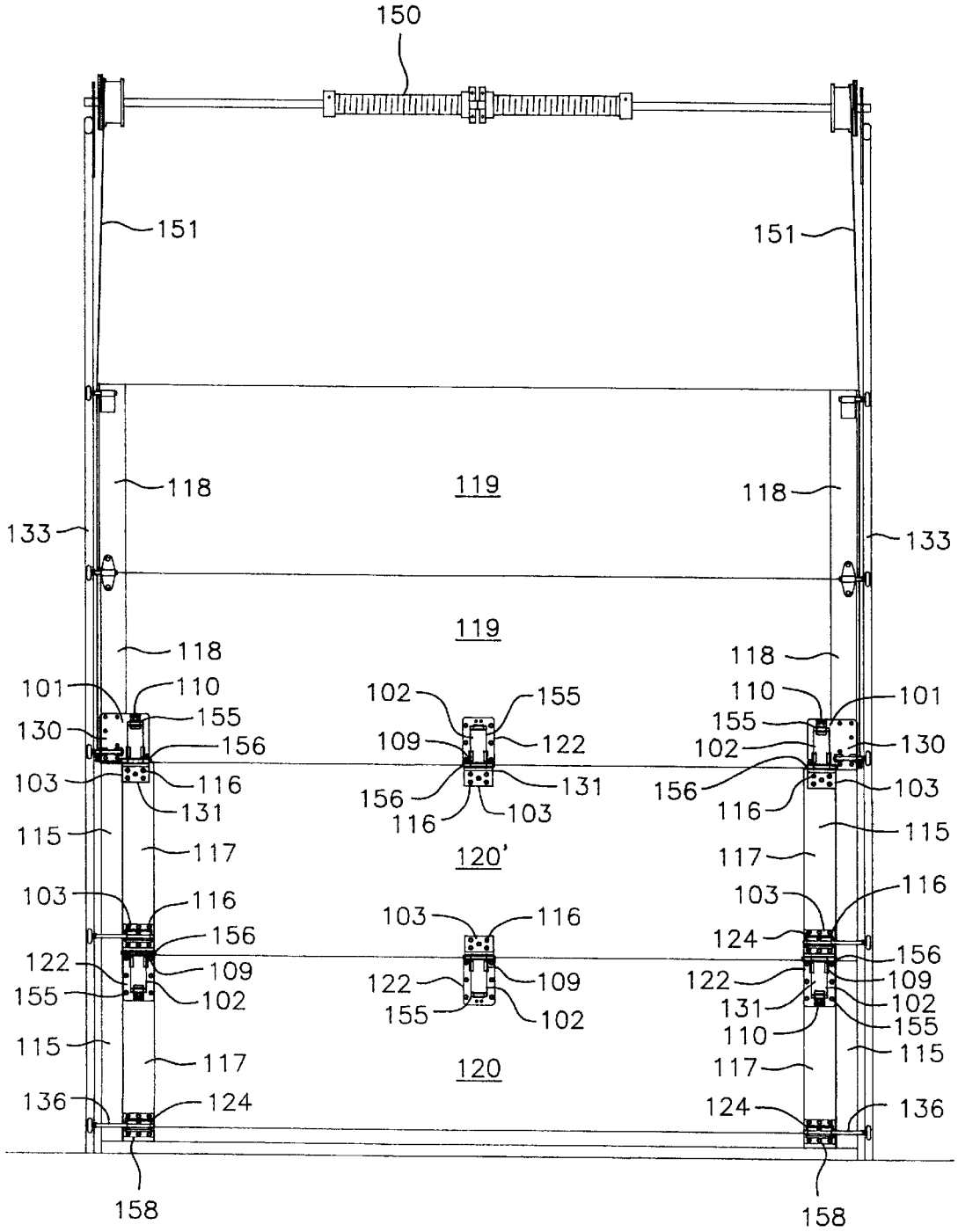
FIG. 10 is an elevation or front view of a sectional door from inside a building showing two breakaway panels and the hinge mechanism reversed upside down from that of the embodiment of FIGS. 1–9.
Figure 11:
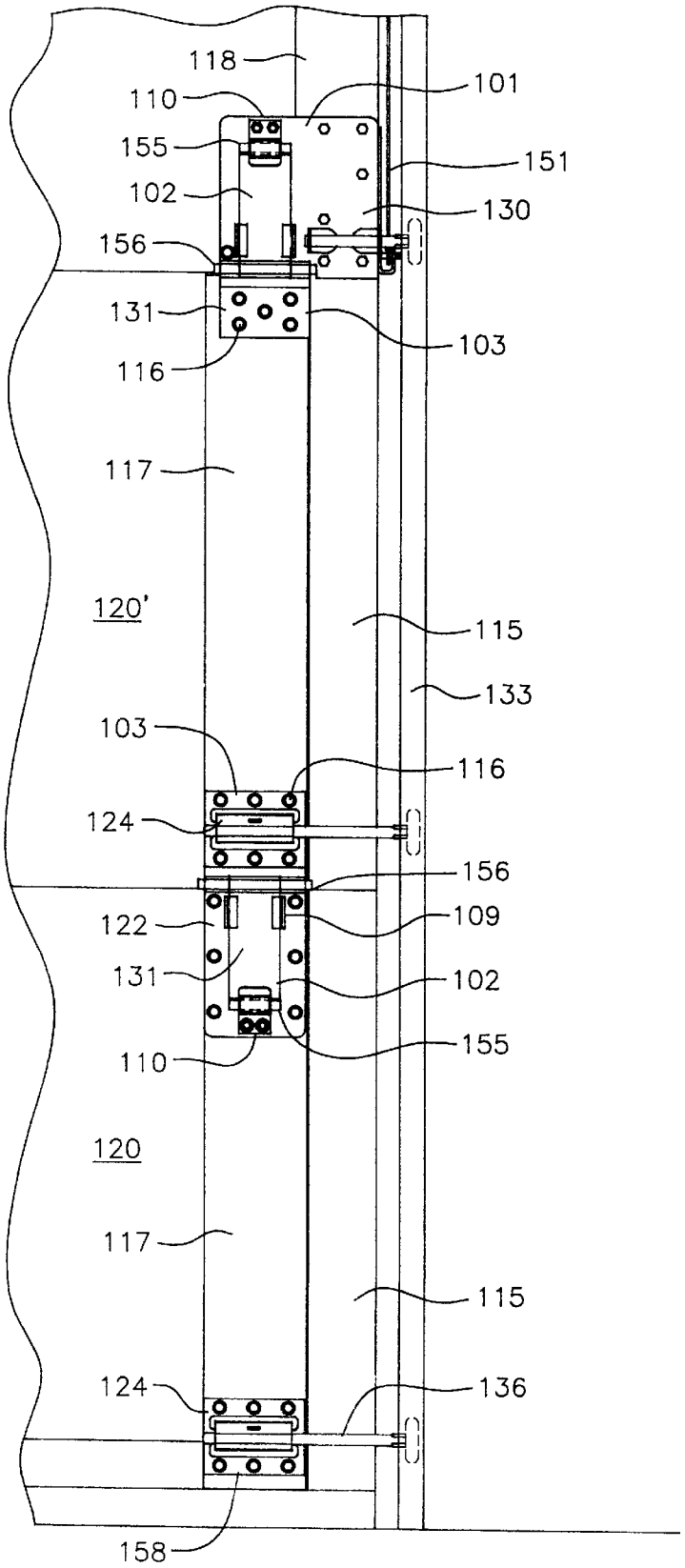
FIG. 11 shows the right hand corner of the bottom and adjacent panels of FIG. 10.
Figure 12:
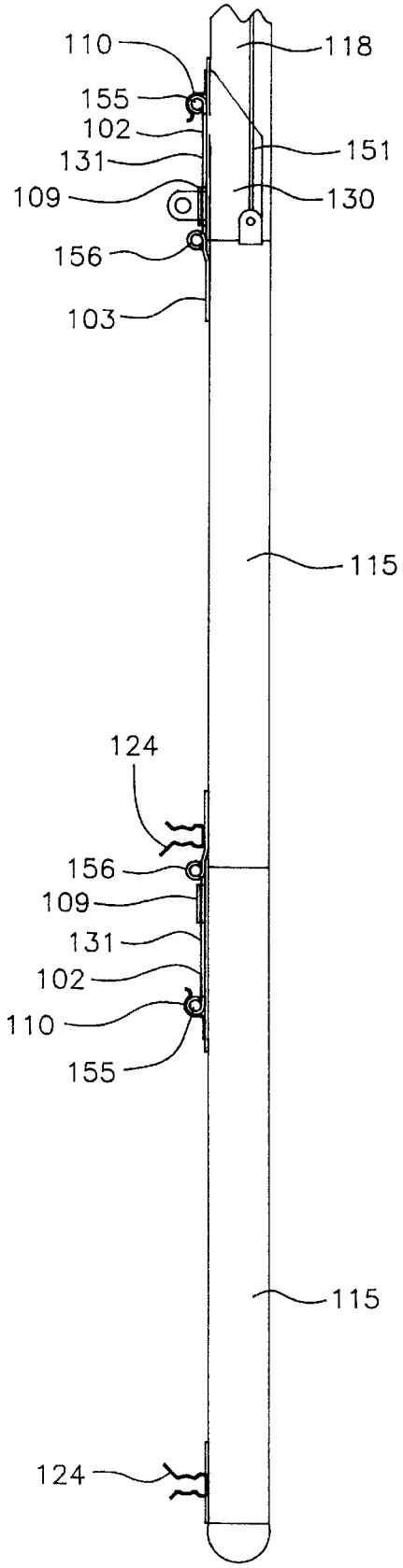
FIG. 12 is an end or side view of the door of FIG. 11.
Figure 13:
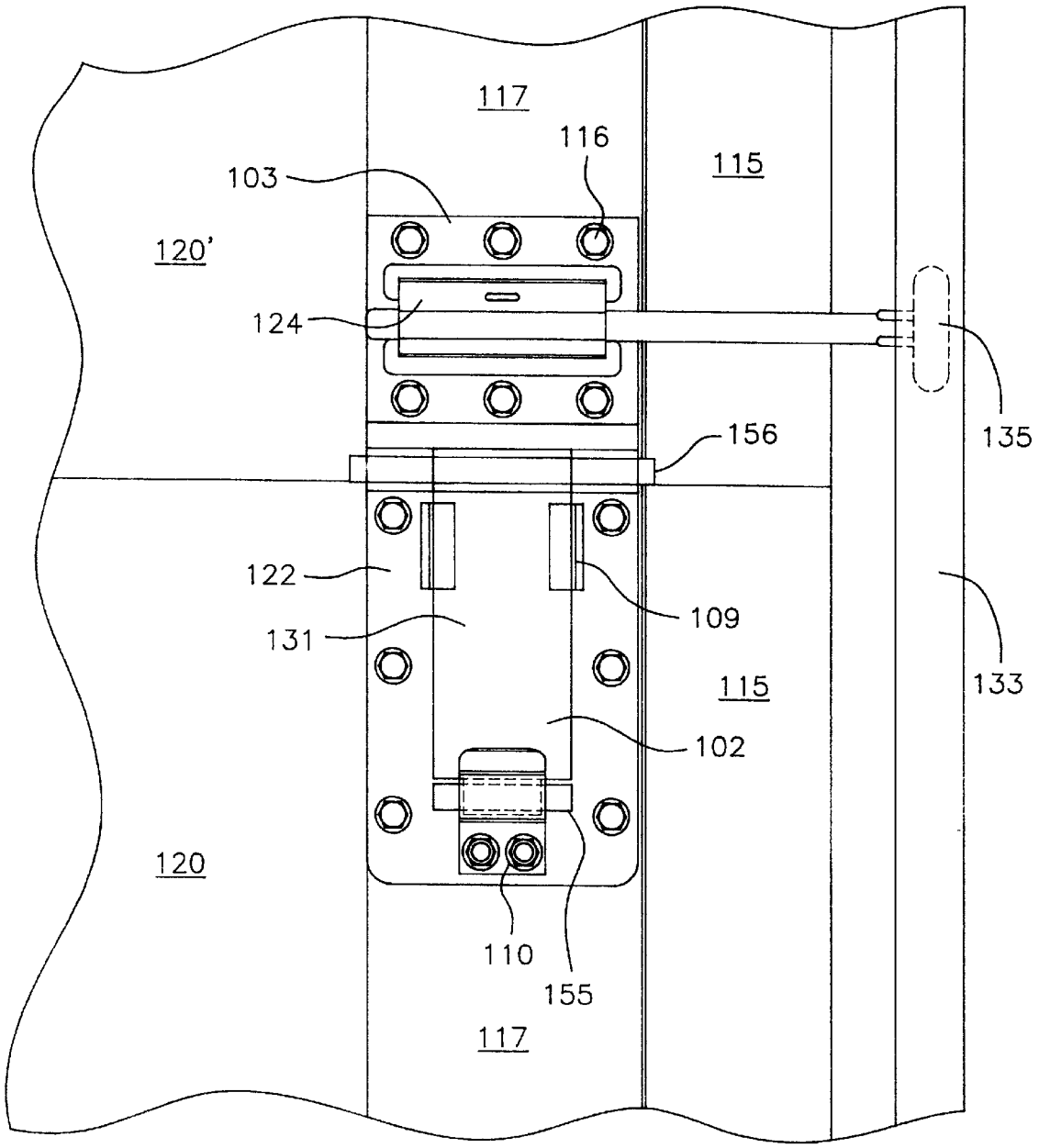
FIG. 13 is a close-up view of the hinge mechanism of FIGS. 10–12.
Figure 14:
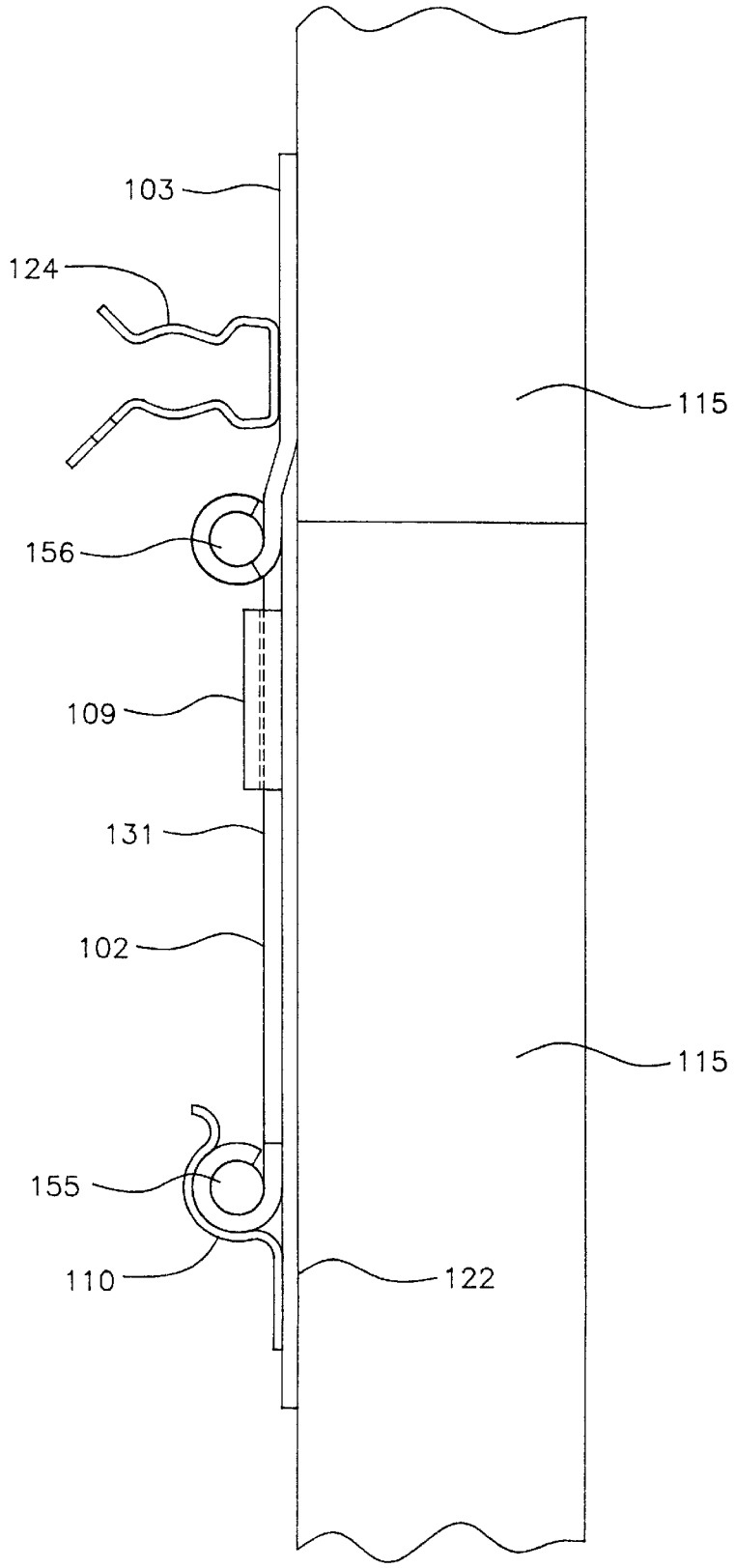
FIG. 14 is a side view of the hinge mechanism of FIG. 13.

FIGS. 8 and 9 depict the pivotal and longitudinal movement of the hinge mechanism 1 and movement of the associated adjacent panels 19, 20 in opposite directions when the releasable panel 20 is impacted with a sufficient force to enable release of the bottommost roller mechanism 35, 36 from its associated retainer spring clip 24, in a manner as disclosed, e.g., in the Lichy '614 patent. In FIG. 8, the releasable panel 20 is depicted, in free space for purposes of clarity, as rotating in a clock-wise direction with respect to the non-releasable panel 19. That is, the inner faces, i.e. the faces that arc exposed to the interior of the building converge toward each other when the bottommost rectangular panel 20 is struck by a force from outside the building to inside the building. In such instance, the bottom or first hinge plate 3 pivots about the pivot pin 56 and the upper or second hinge plate 2 remains captured within the keeper or spring clip 10 and thus the hinge moves in a conventional manner to enable the releasable panel 20 to swing in an inward direction. FIG. 9 depicts a situation where the bottommost releasable panel 20 is struck from inside the building with a sufficient impact force to release the roller (not shown) and rotates in a counterclockwise direction such that its outer face converges with respect to the outer face of the upper panel 19. The pressure of the bottommost panel trying to pivot in a direction toward the thickness of the two panels causes the second hinge plate 2 to release from the spring clip 10 to cause the hinge plate 2 to fall downwardly a sufficient distance, at least equal to the thickness of the rectangular panels 19, 20 to enable the pivot pin 56 and hinge plates 2, 3 to similarly move downwardly and allow the releasable panel 20 to pivot or rotate outwardly.

Figure 15:
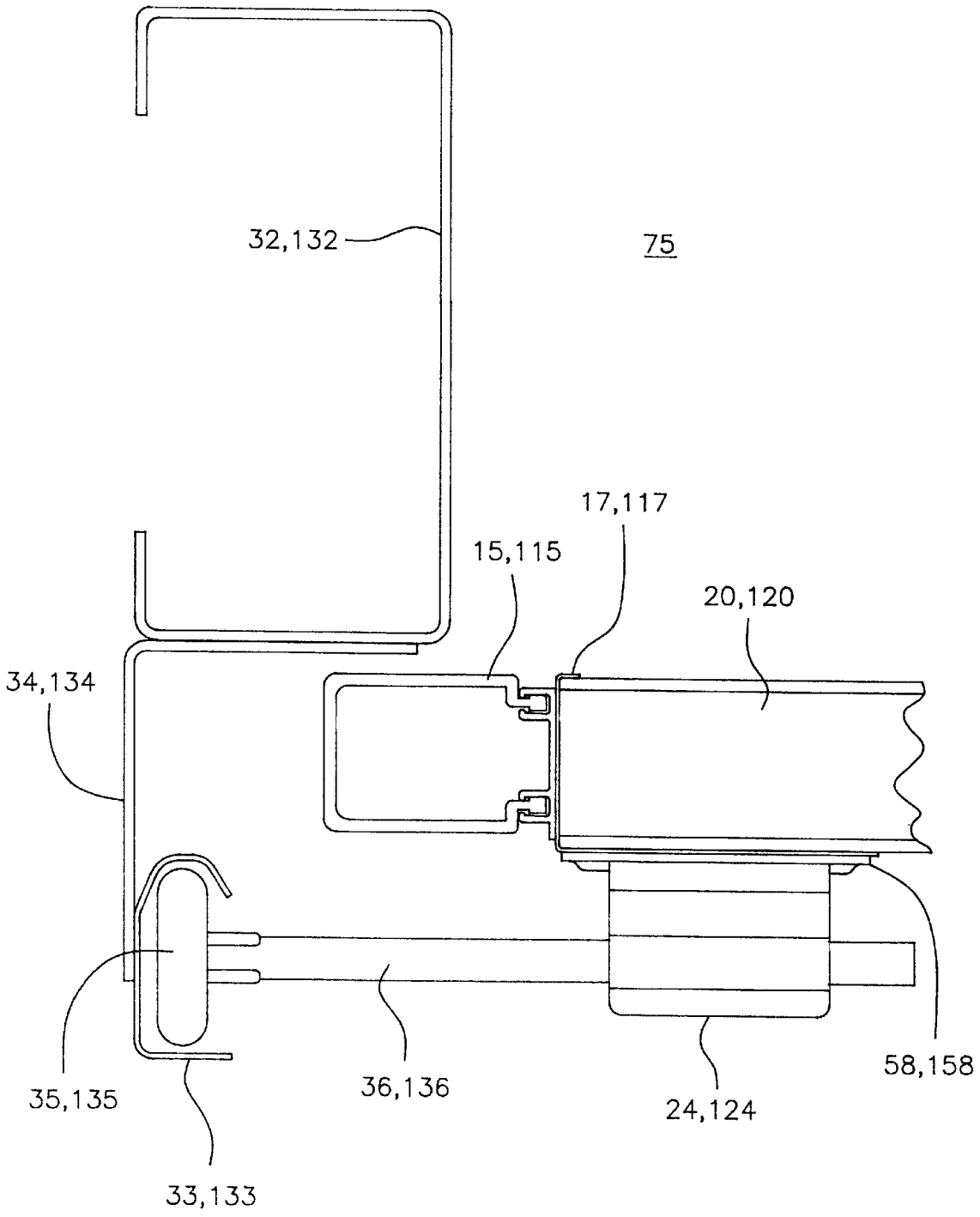
FIG. 15 shows a view looking down at a breakaway bottom panel to show the track and the soft compressible side edge of the panel with the roller retainer mechanism and roller.
Figure 16:
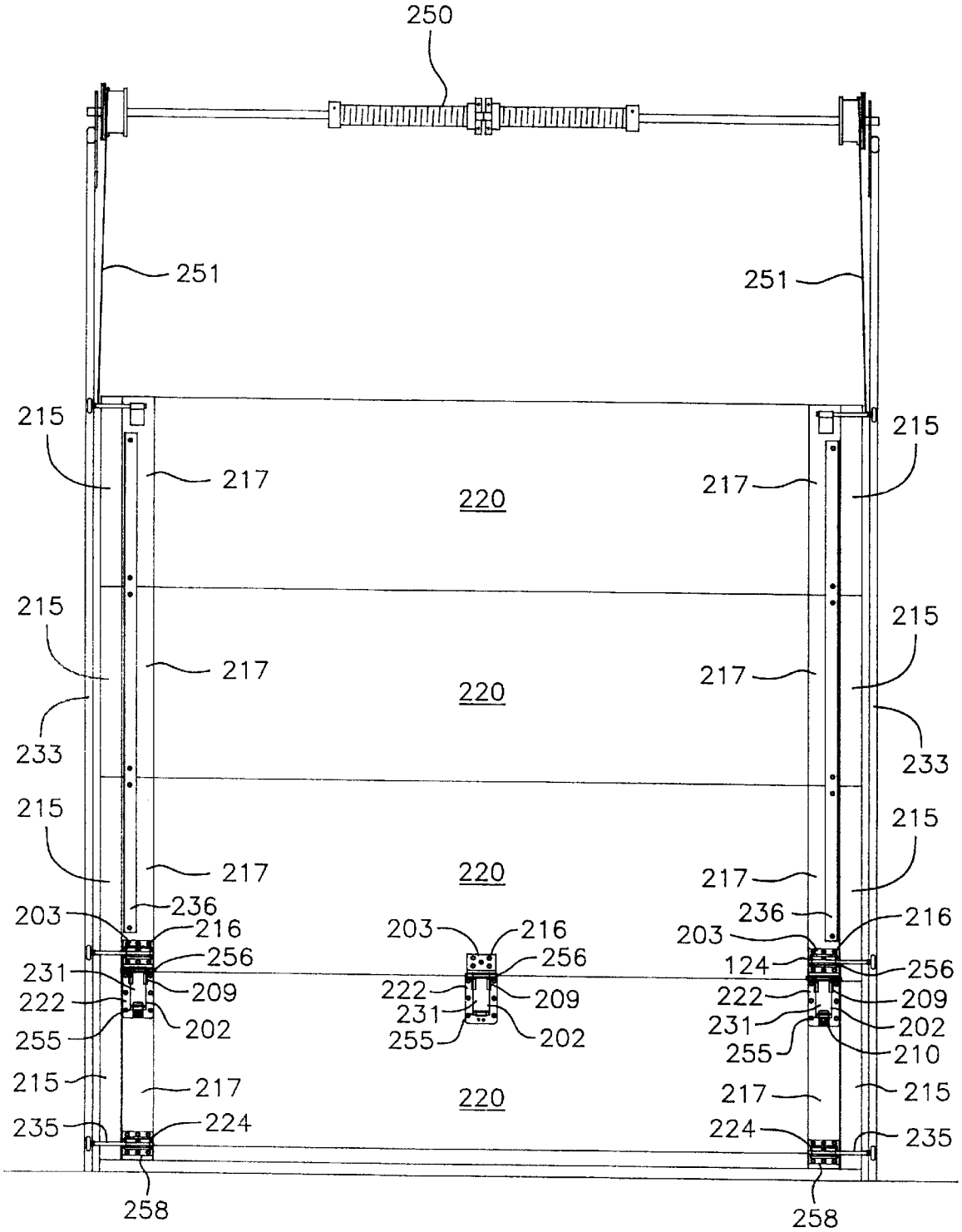
FIG. 16 shows an elevation or front view of a sectional door from inside the building with the bottom panel being a breakaway door panel and all of the other panels fixed together.
Figure 17:
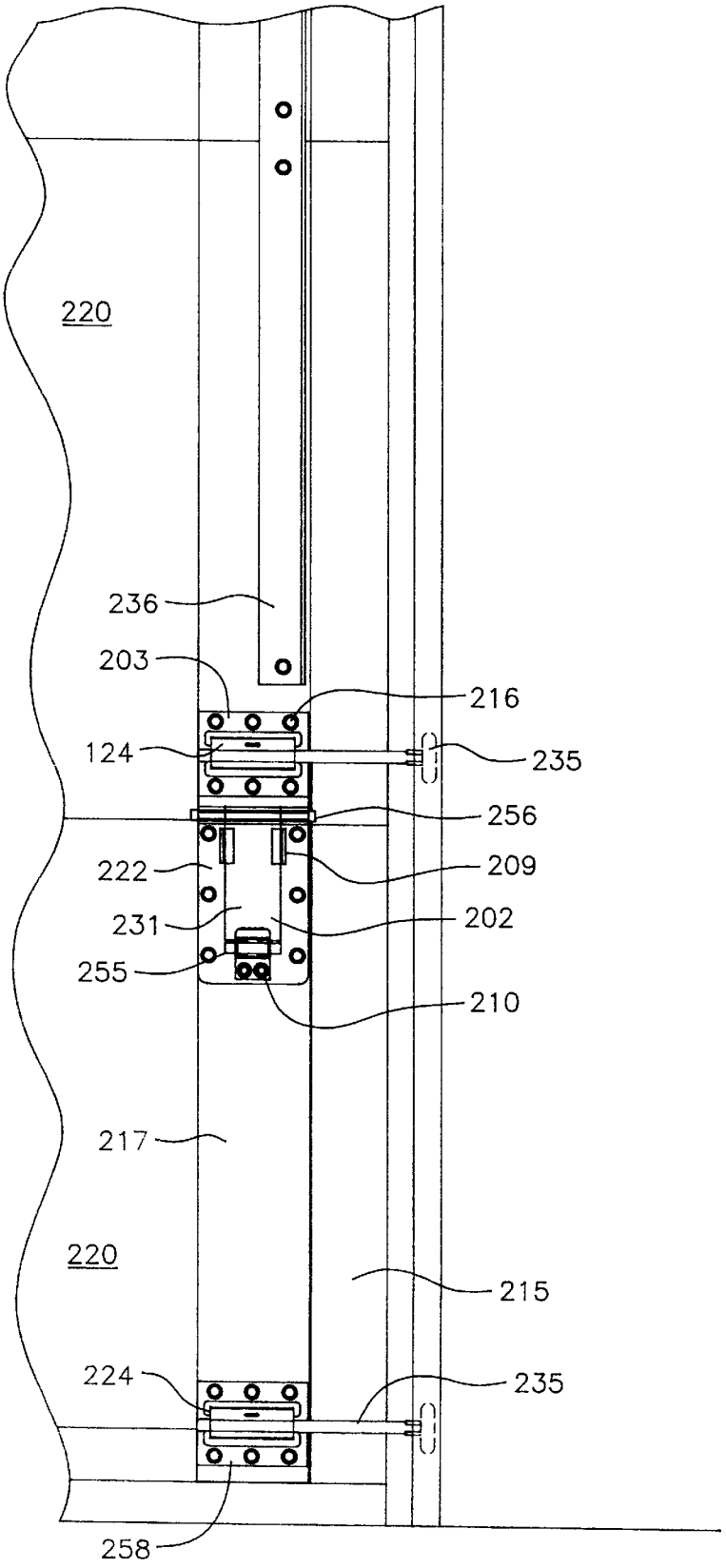
FIG. 17 shows the right hand corner of the bottom and adjacent panels of the door of FIG. 16.
Figure 18:
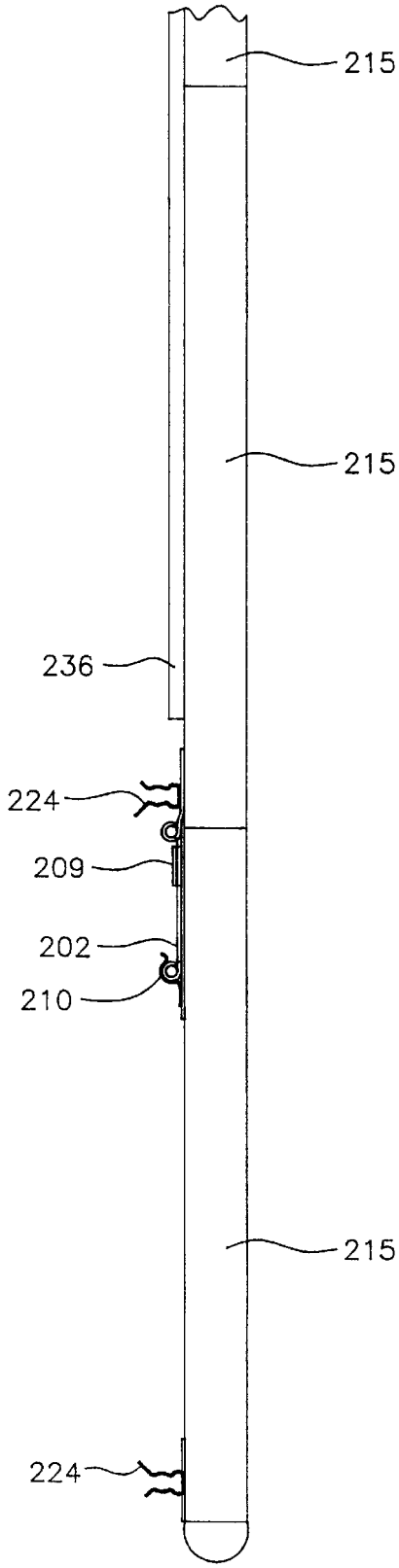
FIG. 18 is a side view of the door of FIG. 17.
Figure 19:
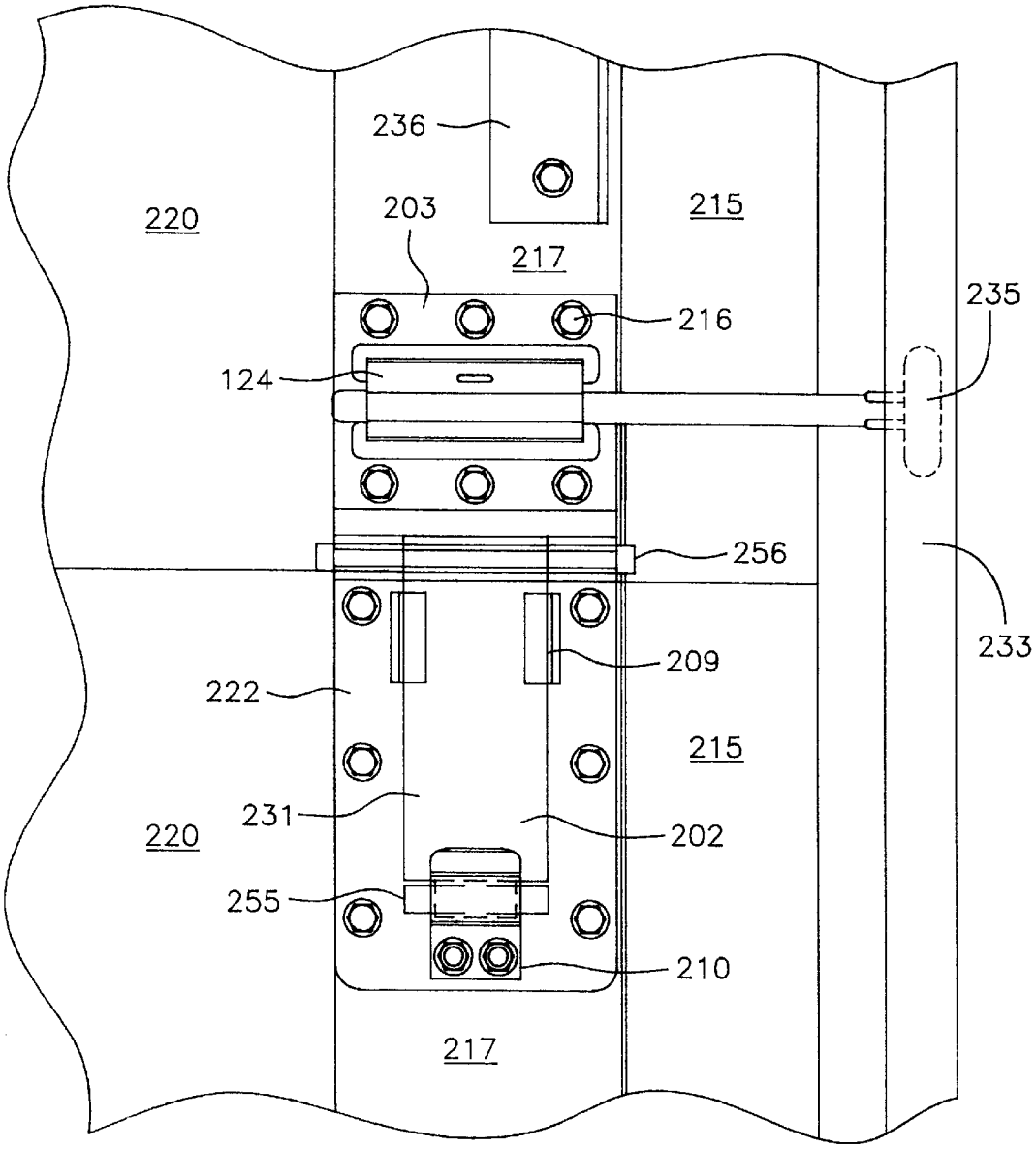
FIG. 19 is a close-up view of the hinge mechanism of FIG. 17.
Figure 20:
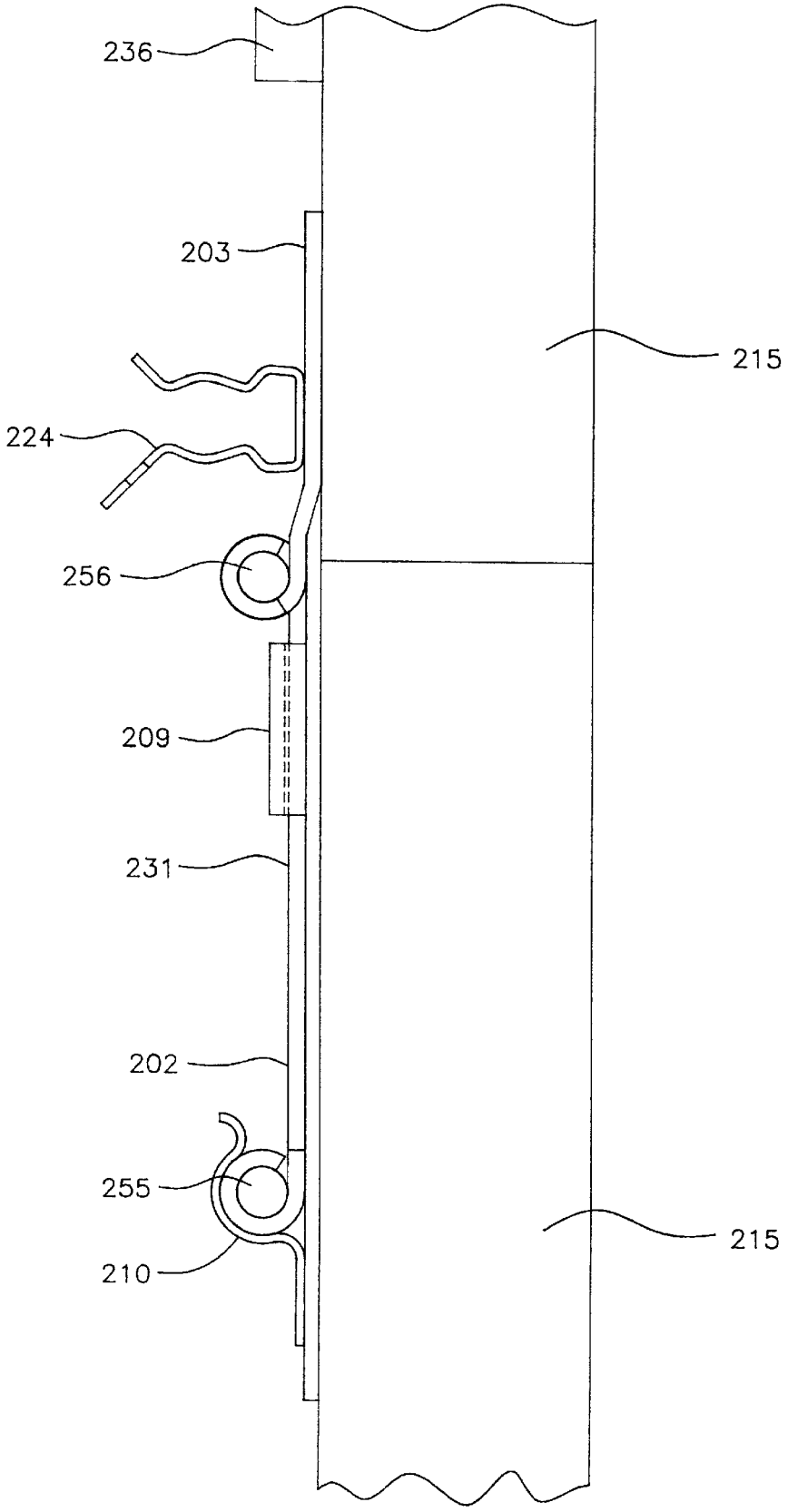
FIG. 20 is a side or end view of the door of FIG. 19.

Turning next to the embodiment of FIGS. 10–14 which also includes the releasable roller arrangement of FIG. 15, this embodiment is a configuration in which the bottommost panel 120 and the adjacent panel 120' are both releasable with panel 120' interconnected with the non-releasable panel 119 immediately adjacent thereto. For convenience, the numerals in this embodiment are substantially identical to those of FIGS. 1–9 except prefixed by the value "100".

This embodiment differs from that of the embodiment of FIGS. 1–9 in that the hinge plates 103 and 102 are reversed. That is, the first hinge plate 103 which is hingedly connected to the second hinge plate 131 which, in turn, is slidably received in a base plate 122 is such that the release of the panel 120 with respect to 120' results in downward movement of the base plate 122 with respect to the second hinge plate 131. In addition, the hinge plate 103 includes a releasable roller similar to the arrangement of the bottommost releasable roller 124, so as to enable release of panel 120' with respect to the non-releasable panel 119. Thus, releasable panel 120' releases with respect to non-releasable panel 119 adjacent thereto in substantially the same manner as the release of panel 20 with respect to adjacent panel 19 in the embodiment of FIGS. 1–9. Similarly, when the bottommost releasable panel 120 is struck in a direction from inside the building toward the outside of the building, the second hinge plate 131 releases from the spring clip 110 in a similar manner as in the FIGS. 1–9 embodiment to enable relative longitudinal or downward movement between the base plate 122 and second hinge plate 131. Another difference between the embodiment of FIGS. 10–14 is that the connecting hook for the counterbalance cable 126 is moved to the first non-releasable panel 119.

Because both the bottom panel 120 and the adjacent panel 120' are both releasable, each of the panels include the soft compressible side edges 115. See, also FIG. 15. These compressible side edges would be compressed if a break-away panel were impacted outwardly towards the jamb 32, 132 as is shown in FIG. 15. The track 33/133 is fastened to a wall angle 34, 134 which in turn is fastened to the jamb 32, 132. If the releasable panel 20, 120 is struck at a sufficient impact force, the roller retainer or spring clip 24, 124 which is made of spring steel would release the roller stem 35 which is an integral part of the roller and thus enabling the panel to swing inwardly or outwardly. As is described in the Lichy '614 patent, the roller stem or shaft 35, 135 is within a tube (not shown) which is captured by the retainer clip 24, 124 to allow the shaft to float or move laterally within the tube. The tube and roller shaft snap out of the clip 24, 124. Preferably, the roller shaft is connected by a cable (not shown) to the panel so that it is left dangling from the panel and will not get lost or become a flying projectile.

Turning next to the embodiment of FIGS. 16–20, the embodiment is similar to that of FIGS. 1–9 and include similar numerals but prefixed by "200". The first difference between the two embodiments is that the hinge mechanisms are reversed and thus similar to that shown in the FIG. 10 embodiment. Another significant difference is that all of the panels above the bottommost releasable panel are securely fastened together with connecting angles 236 which makes all of the panels unitary and non-pivotal with respect to each other. This embodiment could be usable in a full vertical lift door. In this embodiment, the counterbalance cable 251 is attached to one of the upper panels. This embodiment permits the entire door to be knocked loose from the track with little if any damage.

FIGS. 21 and 22 disclose an alternative embodiment for releasing the roller from the track at the two bottom corners. In this embodiment, common elements to FIG. 15 are prefixed with "300". When the releasable panel 320 is impacted from inward to an outward direction, instead of the roller shaft 336 being entirely displaced from the spring retaining mechanism 325, the roller shaft is pivoted at swivel pin 357 to the spring clip retaining mechanism 325 and simply swivels out of the way but remains physically connected to the spring clip. The primary purpose of the embodiment is to releasably retain the shaft of the roller and to release the shaft if and when the section is impacted outwardly. In contrast to the arrangement shown in FIG. 15, where the roller shaft 136 is encapsulated in a tube (not shown), thereby allowing the roller shaft 136 to float inward and outward from the track which, usually is not perfectly plumb, the roller shaft 336 is encapsulated in roller retainer 325 directly without any tube. To enable the roller shaft 336 to float inward and outward, i.e., toward and away from the track 333, the retainer or spring clip 325 is captured in a slot (not shown) in mounting plate 358 to enable the retainer to move laterally as shown by the double arrows 380 on FIG. 21. The roller retainer 325 keeps the roller shaft 335 attached after impact by means of the swivel pin 357 interconnected between the roller retainer 325 and roller shaft 335. The roller retainer 24 and 124 of the FIG. 15 embodiment will release the roller shaft 35 or 135 if the panel is impacted from either direction, whereas roller retainer 325 will release the roller shaft 335 if the panel is impacted from one side, i.e. the inside as shown, only. See FIG. 22 which shows the release from inside to outside. This release mechanism may be utilized in the embodiment of FIGS. 10–14 where the retainer spring clip is attached to first hinge plate 103.

In order for the embodiment of FIGS. 21 and 22 to be operable to release the panel when struck from the outside toward the inside, the track 333 is modified to be formed from a flexible plastics material, such as an ultrahigh molecular weight plastics material but is weakened or slit at point 390 where the track 333 has a substantially L-shaped corner. When the door 320 receives a sufficiently high impact force from the outside to the inside of the building, i.e., opposite to that shown in FIG. 22, flexure occurs about the weakened point 390 to enable the shaft 336 and roller 335, remaining captured within the retaining clip 325, to disengage by flexure of the L-shaped corner of the track. The plastics material not only pivots about the weakened portion but there is also some flexure of the material itself. On the other hand, the material must be sufficiently strong so that when a force is provided from inside the building to outside as shown in FIG. 22, the track 333 is still strong enough to act as the reactant force to enable the shaft 336 to break away from the spring clip 325. Depending on the characteristics of the plastics material that forms the track, the inclusion of a weakened portion or slit at point 390 may be unnecessary.

The hinge mechanism 1 of the present invention has particular utility in overhead sectional doors or garage doors as has been described. However, the hinge mechanism 1 may have independent utility in interconnecting any two substantially rectangular panels that require pivotal movement with respect to each other in opposite directions. Suitable modifications may be required, for example the imposition of a spring mechanism to enable the panels to move back into their aligned position after one rectangular panel is moved or rotated in a direction that causes longitudinal separation, may be required.

The foregoing is considered as illustrative only of the principles of the invention. Further, since numerous modifications and changes will readily occur to those skilled in the art, it is not desired to limit the invention to the exact construction and operation shown and described and, accordingly, all suitable modifications and equivalents may be resolved to falling within the scope of the invention as defined by the claims.

What is claimed is:

1. A sectional door having vertically movable rectangular door panels, including a door hinge mechanism connecting a first rectangular panel with a second rectangular panel wherein each of said first and second rectangular panels include a first face and a second face defining a thickness therebetween, said second panel positioned vertically above said first panel, and wherein the top edge of said first panel faces the bottom edge of said second panel, wherein said hinge mechanism includes a first hinge plate fixedly coupled to one of said first and second panels and a second hinge plate slidably coupled to the other of said first and second panels.

2. The sectional door of claim 1 wherein said second hinge plate enables its connected panel to have a displacement at least equal to the thickness of its connected panel.

3. The sectional door of claim 1 wherein said first and second hinge plates are pivotal with respect to each other about a single hinge pin.

4. The sectional door of claim 1 wherein said second hinge plate is releasably connected to said second rectangular panel to enable said second hinge plate and said second rectangular panel to move vertically with respect to each other.

5. The sectional door of claim 1 further comprising a base plate fixed to said other of said first and second rectangular panels, said second hinge plate releasably connected to said base plate.

6. The sectional door of claim 5 wherein said base plate includes a spring clip to releasably engage said second hinge plate.

7. The sectional door of claim 5 wherein said base plate includes guides to slidably receive said second hinge plate, wherein said second hinge plate is releasable from, and slidable vertically with respect to, said base plate.

8. The sectional door of claim 1 wherein said first and second rectangular panels form part of a vertically-movable sectional overhead door with at least the first rectangular panel releasable from the door upon receipt of a predetermined impact force thereon.

9. A vertically movable sectional door comprising a plurality of articuably connected rectangular panels mountable adjacent a door opening for opening and closing the door opening, at least the bottommost rectangular panel interconnectable with vertical tracks located adjacent side edges of the door opening and releasable from the vertical tracks upon receipt of a predetermined impact force applied to said releasable rectangular panel, wherein said releasable rectangular panel is connected to an adjacent panel through a hinge mechanism having a first hinge plate fixed to one of said bottommost and adjacent panels and a second hinge plate releasably connected with the other of said bottommost and adjacent panels, said bottommost and adjacent panels vertically displaceable from each other to enable said panels and hinge plates to pivot inwardly and outwardly with respect to each other.

10. The sectional door of claim 9 wherein said hinge mechanism includes only a single pivot pin about which said hinge plates pivot.

11. The sectional door of claim 9 wherein said second hinge plate is releasably connected to a base plate affixed to said other of said bottommost and adjacent panels, said base plate capturing said second hinge plate to enable relative vertical movement therebetween.

12. The sectional door of claim 11 wherein said base plate is non-releasably connected with one of said vertical tracks.

13. The sectional door of claim 11 wherein said other rectangular panels is a releasable panel and said first hinge plate is releasably connected with one of said vertical tracks.

14. A vertically movable sectional door comprising at least two articuably connected rectangular panels mountable adjacent a door opening for opening and closing the door opening, at least the bottommost rectangular panel interconnectable with vertical tracks located adjacent side edges of the door opening and releasable from the vertical tracks upon receipt of a predetermined impact force applied to said releasable rectangular panel, wherein one of said rectangular panels includes a hinge having a first hinge plate hinged to a second hinge plate, said first hinge plate affixed to said one of said of rectangular panels, the other of said rectangular panels including a base plate for slidably receiving and retaining said second hinge plate to enable relative vertical movement of the hinge with respect to said base plate and enable relative vertical and relative angular movement between said rectangular panels in opposite directions.

15. The sectional door of claim 14 wherein said first hinge plate is releasably connected with one of said vertical tracks.

16. The sectional door of claim 15 wherein said second hinge plate is releasably connected to said base plate to enable relative slidable movement therebetween.

17. The sectional door of claim 14 wherein said first hinge plate is affixed to said bottommost rectangular panel.

18. The sectional door of claim 17 wherein said base plate is affixed to an adjacent panel and is non-releasably connected to one of said vertical tracks.

19. The sectional door of claim 14 wherein said base plate is affixed to said bottommost releasable panel.

20. The sectional door of claim 19 wherein said first hinge plate is affixed to an adjacent panel and is releasably connected to one of vertical tracks.

21. A pair of substantially planar panels that are pivotal with respect to each other in opposite directions, said panels defining panel edges, and a pivotal connecting mechanism for connecting the panels in edge-to-edge relationship with the panels aligned substantially coplanar, said pivotal connecting mechanism including means for enabling the panels to separate from each other in the planar direction and simultaneously pivot with respect to each other in at least one direction.

22. The panel arrangement of claim 21 wherein said means includes a hinge plate fixedly connected with one panel and a base plate fixedly connected with the other panel, and a hinge leaf pivotally connected with said hinge plate and slidably and releasably connected with said base plate.

23. A panel arrangement including a hinge connecting a first rectangular panel with a second rectangular panel wherein each of said first and second rectangular panels includes a first face and second face defining a thickness therebetween, said second panel positioned vertically above said first panel and wherein the top edge of said first panel faces the bottom edge of said second panel, wherein said hinge includes first and second hinge plates coupled to said first and second panels respectively at said first face of each panel, wherein said first and second hinge plates are pivotal with respect to each other in a direction where the first faces of each panel converge and wherein said first and second hinge plates are displaceable from said second panel and pivotal with respect to each other in a direction where the second faces of each panel converge, such that said first and second panels are pivotal in clockwise and counterclockwise directions.

24. The panel arrangement of claim 23 wherein said longitudinal displacement is at least equal to the thickness of said first panel.

25. The panel arrangement of claim 23 wherein said first and second hinge plates arc pivotal with respect to each other about a single hinge pin.

26. The panel arrangement of claim 23 wherein said second hinge plate is releasably connected to said second rectangular panel to enable said second hinge plate to move vertically downward from said second rectangular panel.

27. The panel arrangement of claim 25 further comprising a base plate fixed to said first face of said second rectangular panel, said second hinge plate releasably connected to said base plate.

28. The panel arrangement of claim 27 wherein said base plate includes a spring clip to releasably engage with said second hinge plate.

29. The panel arrangement of claim 27 wherein said base plate includes guides to slidably receive said second hinge plate wherein said second hinge plate is releasable from, and slidable vertically with respect to, said base plate.

30. The panel arrangement of claim 23 wherein said first and second rectangular panels form part of a vertically-movable sectional overhead door, at least the first rectangular panel releasable from a frame of the door.

31. A vertically movable sectional door comprising at least two articuably connected rectangular panels mountable adjacent a door opening for opening and closing the door opening and flexible vertical tracks located adjacent side edges of the door opening, at least the bottommost rectangular panel interconnectable with said flexible vertical tracks and releasable from the vertical tracks upon receipt of a predetermined impact force applied to said releasable rectangular panel, wherein said releasable rectangular panel comprises, on an inside face of said panel at each bottom corner, a roller shaft pivotally connected at one shaft end with said releasable panel and connected at its other shaft end with a roller captured within said flexible vertical track, wherein release of the releasable panel in a direction from the inside to the outside results in pivoting of said shaft and release of said roller from said vertical track, and wherein release of the releasable panel in a direction from the outside to the inside results in release of said roller from said vertical track by flexure of said track.

32. The sectional door of claim 31 wherein said flexible vertical track is of plastic and includes a pivotal and flexible section to enable flexure for release of said roller.

33. A hinge comprising a first hinge plate rotatably coupled to a second hinge plate about a single hinge pin, a base plate including a pair of guides and a releasable retaining means for retaining the second hinge plate to said base plate and for releasing the second hinge plate from said base plate at a predetermined separation force therebetween, said second hinge plate captured within said pair of guides, and slidable within said pair of guides when released from said releasable retaining means.

34. The hinge of claim 33 wherein said first hinge plate includes attachment means for fixedly attaching said first hinge plate to a first panel, and said base plate includes attachment means for fixedly attaching said base plate to a second panel for enabling the panels to pivot in opposite directions.

35. The hinge of claim 33 wherein said releasable retaining means includes a flexible spring clip that receives and releasably retains a cylindrically-shaped extension of said second hinge plate.

* * * * *